United States Patent [19]

Tuma

[11] Patent Number: 4,843,748

[45] Date of Patent: Jul. 4, 1989

[54] FIREARM

[75] Inventor: Martin Tuma, Solothurn, Switzerland

[73] Assignee: ITM Industrial Technology & Machines AG, Solothurn, Switzerland

[21] Appl. No.: 236,020

[22] Filed: Aug. 24, 1988

[51] Int. Cl.[4] ..... F41C 17/04

[52] U.S. Cl. ..... 42/70.08

[58] Field of Search ..... 42/70.08

[56] References Cited

U.S. PATENT DOCUMENTS

| | | | |
|---|---|---|---|
| 3,830,002 | 8/1974 | Volkmar | 42/70.08 |
| 4,021,955 | 5/1977 | Curtis | 42/70.08 |
| 4,658,529 | 4/1987 | Bertolini | 42/70.08 |

*Primary Examiner*—Stephen C. Bentley
*Attorney, Agent, or Firm*—Ladas & Parry

[57] ABSTRACT

A locking plunger which is perpendicularly movable relative to the direction of movement of the firing pin allows or prevents the axial movement of the firing pin to fire the gun. This locking plunger is spring biassed to abut a safety lever which is part of the sear of the operating members of the gun. The safety lever is located and arranged such on the sear that it allows a movement of the locking plunger into the firing pin unlocking position upon the operating members of the gun reaching the end of the trigger slack. Accordingly a movement of the locking plunger into the unlocking position will proceed not earlier than the sear snapping into the firing position. Any other accidental limited movements of the operating parts of the gun including such of the hammer cannot cause an axial movement of the firing pin because such movement is positively prevented by the locking plunger. Therefore, an accidental firing of the gun is positively prevented.

3 Claims, 2 Drawing Sheets

FIREARM

BACKGROUND OF THE INVENTION

1. Field of the Invention

The present invention relates to a firearm including a barrel, a cartridge chamber, a pivotally movable trigger connected to a trigger bar cooperating with a sear reciprocatingly rotatable between a firing position and a rest position, a cockable hammer and a firing pin supported for reciprocating axial movement in a firearm block part, which firing pin upon a pulling of the trigger past the trigger slack is movable by action of the hammer against the force of a restoring spring from a rest position into a firing position to strike against a cartridge located in the cartridge chamber.

2. Description of the Prior Art

Firearms and specifically handguns of the kind set forth above are bestowed the dangerous drawback of an accidental firing which has in many instances led to an injuring or even killing of a human being. Such accident may occur if when, for instance, pulling or drawing, respectively, a gun, the trigger or hammer that accidentally temporarily caught at an obstruction e.g. clothing resulting in a slight moving thereof snaps back into the original position after clearing the obstruction allowing or causing, respectively, a minor movement of the firing pin, which may, however, be sufficient to strike the ignitor with such a force that the gun is fired. A further cause may be that the gun can accidentally strike against a hard surface or even being dropped such that the firing pin is moved due to inertial forces resulting again in an accidental and dangerous firing of the gun.

SUMMARY OF THE INVENTION

It is, therefore, an object of the present invention to provide a firearm, in which an accidental moving of the firing pin due to outside influences is positively prevented.

A further object of the invention is to provide a firearm which comprises a spring loaded locking plunger supported in a firearm block part for a reciprocating movement between a locking position preventing an axial movement of the firing pin and a release position allowing an axial movement of the firing pin, and in which the rotatable sear comprises a safety lever abutting the locking plunger and located such that in the rest position of the sear the safety lever urges the locking plunger against the force of the spring acting thereupon into its firing pin locking position and in the firing position of the sear it releases the locking plunger allowing a spring actuated movement thereof into its firing pin release position.

A further object is to provide a firearm in which the safety lever of the rotatable sear is located and arranged such that its position of releasing the locking plunger coincides with the position of the sear at the end of the trigger slack.

Still a further object of the present invention is to provide a firearm in which the locking plunger is guided to move perpendicularly relative to the firing pin and includes a through bore having a center axis extending in the direction of the longitudinal axis of the firing pin, further in which the firing pin includes a first collar axially followed by a first intermediate section, followed in turn by a second intermediate section, followed finally by a second collar, which first collar is located at the smallest and which second collar is located at the largest distance from the tip of the firing pin, which first collar has an outer diameter which is larger than the inner diameter of the through bore whereby an abutment stop is formed limiting the spring initiated restoring movement of the firing pin, which first intermediate section has an outer diameter which is smaller than the inner diameter and an axial length corresponding to the axial length of the through bore, which second intermediate section has an outer diameter corresponding to the inner diameter of the through bore such to be receivable therein and has an axial length corresponding to the axial length of the through bore, which second collar has an outer diameter which is larger than the inner diameter of the through bore whereby a further abutment stop is formed limiting the hammer initiated firing movement of the firing pin.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
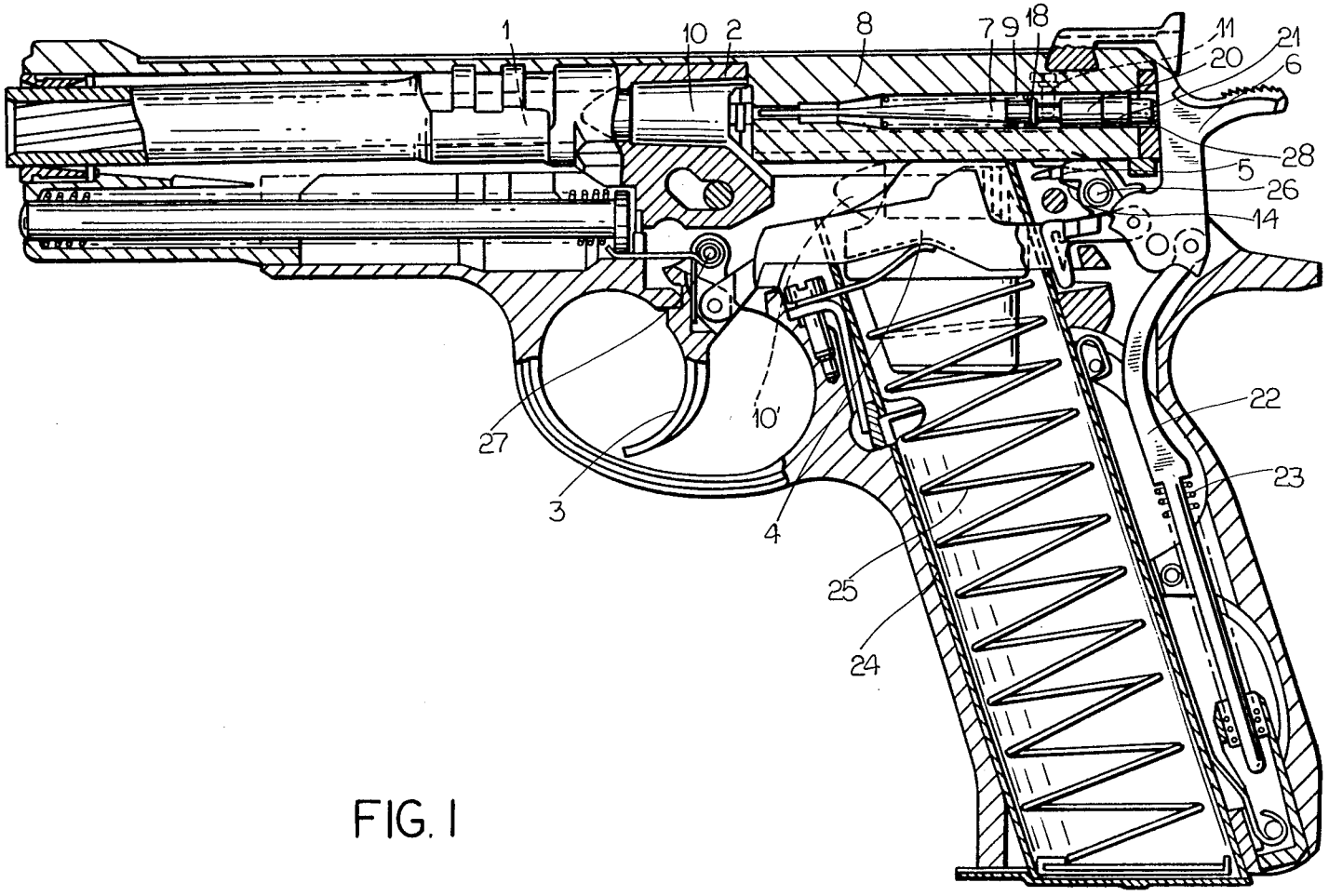
FIG. 1 is a cross-sectional view of a part of a handgun incorporating a preferred embodiment of the invention.

FIG. 1 illustrates a sectional view of a handgun, in which the invention is embodied. The handgun, here a pistol, is generally of a commonly known design such that a detailed description thereof is not necessary for a person skilled in the corresponding art such that only an abridged description thereof is needed for understanding the present invention.

The handgun includes a barrel 1 ending at a cartridge chamber 2. According to the illustration of FIG. 1 a cartridge 10 is loaded in the cartridge chamber 2. A firearm block part 8 housing the firing pin 7 adjoins the cartridge chamber 2. The firing pin 7 is biassed by a restoring pin 9 into its rest position.

The pivotally movable trigger 3 is connected to a trigger bar 4 cooperating in turn with a reciprocatingly rotatable sear 5 which in turn cooperates with the hammer 6. The positions of these four members are shown in the rest position in which the hammer is in the down position. When the pivotable hammer 6 is cocked, it compresses via a transition link 22 its biassing spring 23.

Also illustrated is the clip 24 for the cartridges including its cartridge feeding spring 25, whereby one cartridge 10' is shown in the loading position.

When the hammer 6 is cocked, the spring loaded sear 5 is rotated clockwise around the pivot axis 26 such to lock the hammer in its fully cocked position. In order to fire the gun the trigger 3 is pulled, based on the illustration of FIG. 1, towards the right-hand side such that it rotates around the pivot axis 27 initiating a movement of the trigger bar 4 towards the right based on the illustration. Upon overcoming the trigger slack the sear 5 rotating counterclockwise around its pivot axis 26 and releases the hammer 6 which strikes against the rear end 28 of the firing pin 7 which is biassed by the restoring spring 9 into the illustrated position such to propel the firing pin 7 against the cartridge 10 located in the cartridge chamber 2 whereupon the gun is fired.

All above mentioned structural members and operational movements are commonly known in the art.

In order now to prevent an accidental firing due to the reasons set forth above a safety arrangement embodying the present invention is integrated in the handgun.

Figure 2:
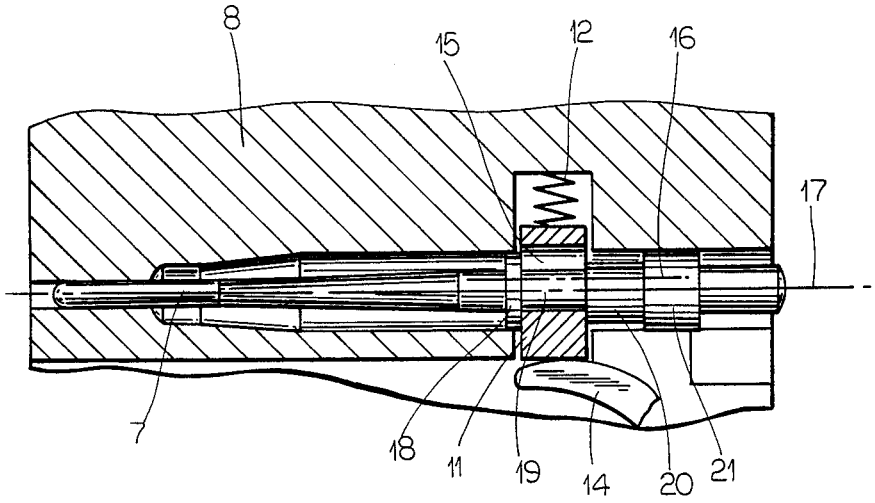
FIG. 2 illustrates on an enlarged scale more in detail the firing pin and the locking plunger.

Attention is now drawn to FIG. 2 which illustrates on a somewhat enlarged scale and somewhat more schematically the part of the handgun which houses the firing pin 7. The firing pin 7 is reciprocatingly movable in the direction of its center axis 17. For sake of clarity the restoring spring 9 illustrated in FIG. 1 is omitted in the drawing of FIG. 2. A locking plunger 11 is located in the firearm block part 8 and reciprocally movable in a direction perpendicularly to the center axis 17 of the firing pin 7. The locking plunger 11 has a through bore 15 with an axis 16 extending parallel to the axis 17 of the firing pin 7. A biassing pressure spring 12 biases this locking plunger 11 downwards to continuously abut a safety lever 14. This safety lever 14 is now an integral part of the sear 5 (see hereto FIG. 1). Referring now to the above explained movements of the structural members of the gun when firing the gun it becomes obvious that upon passing the trigger slack this safety lever 14 will together with the snapping movement of the sear 5 rotate counterclockwise around the pivot axis 26 of the sear 5.

Important to note is here that mentioned rotating movement of the safety lever 14 occurs not earlier than after the passing of the trigger slack such that in all positions of e.g. the trigger 3 the locking plunger 11 remains in the locking position illustrated in FIG. 2. In this position the firing pin 7 is blocked such that it cannot move in either of the two axial directions defined by the axis 17.

The firing pin 7 includes a first collar 18. This first collar 18 has a diameter which is larger than the inner diameter of the through bore 15 of the locking plunger 11. By abutting the locking plunger 11 this first collar 18 limits accordingly the restoring spring 9 initiated movement of the firing pin 7 into its rest position. Additionally as can be seen in FIG. 2 this first collar 18 forms a sliding guide of the firing pin 7 within the firearm block part 8.

This first collar 18 is axially followed by a first intermediate section 19. The outer diameter of this first intermediate section 19 is smaller than the inner diameter of the through bore 15. The length of the first intermediate section 19 corresponds to the length of the through bore 15 such that in the illustrated locking position it fits axially snugly in the through bore 15 leading as is evident from the drawing to a guiding of the movement of the blocking plunger 11 perpendicularly to the firing pin 7.

This first intermediate section 19 is in turn followed by a second intermediate section 20. The outer diameter of the second intermediate section 20 corresponds such to the inner diameter of the through bore 15 that it can be moved thereinto. The axial length of the second intermediate section 20 corresponds roughly to the axial length of the through bore 15 of the locking plunger 11. Accordingly, when the locking plunger 11 has been released by the safety lever 14 of the sear 5 to move downwards, the firing pin 7 is given free to be propelled towards the left by the hammer 6 striking onto its rear end 26, whereby the second intermediate section 20 glides into the through bore 15.

This second intermediate section 20 is finally followed by a second collar 21. The outer diameter of this second collar 21 is larger than the inner diameter of the through bore 15. This second collar 21 limits conclusively the firing movement of the firing pin 7 in that it comes to abut the flank of the locking plunger 11 upon the firing. Additionally, the second collar 21 forms a further axial guiding support of the firing pin 7 in the firearm block part 8.

It has been said above that the safety lever 14 will start its downwards pivoting movement allowing a corresponding movement of the locking plunger 11 not earlier than the operating members of the firearm have passed the trigger slack. In any other position an axial moving of the firing pin 7 and thus accidental firing of the gun is absolutely impossible such that a large safety regarding an unintentional firing is arrived at.

It shall be noted that the disclosed inventive safety structure acting onto the firing pin is embodied in addition to the generally known normal safety catch of firearms, such as e.g. of the AT 84 pistol of the ITM (Industrial Technology and Machines AG) company. Specifically to be noted is that the hammer of the AT 84 of the ITM may be brought into three positions, namely: hammer down, half cock and full cock, and that the present invention is operative in each of the three mentioned hammer positions.

While there is shown and described a present preferred embodiment of the invention, it is to be distinctly understood that the invention is not limited thereto, but may be otherwise variously embodied and practiced within the scope of the following claims.

I claim:

1. A firearm, including a barrel, a cartridge chamber, a pivotally movable trigger connected to a trigger bar cooperating with a sear reciprocatingly rotatable between a firing position and a rest position, a cockable hammer, and a firing pin supported for reciprocating axial movement in a firearm block part, which firing pin upon a pulling of the trigger past the trigger slack is movable by action of said hammer against the force of a restoring spring from a rest position into a firing position to strike against a cartridge located in said cartridge chamber, comprising a spring loaded locking plunger supported in said block for a reciprocating movement between a locking position preventing an axial movement of said firing pin and a release position allowing an axial movement of said firing pin, said rotatable sear comprising further a safety lever abutting said locking plunger and located such that in the rest position of the sear said safety lever urges said locking plunger against the force of the spring acting thereupon into its firing pin locking position and in the firing position of the sear it releases said locking plunger allowing a spring actuated movement thereof into its firing pin release position.

2. The firearm of claim 1, in which said safety lever is located and arranged such that its position of releasing said locking plunger coincides with the position of the sear at the end of the trigger slack.

3. The firearm of claim 1, in which said locking plunger is guided to move perpendicularly relative to said firing pin and includes a through bore having a center axis extending in the direction of the longitudinal axis of said firing pin, further in which said firing pin includes a first collar axially followed by a first intermediate section, followed in turn by a second intermediate section, followed finally by a second collar, which first collar is located at the smallest and which second collar is located at the largest distance from the tip of the firing pin, which first collar has an outer diameter which is larger than the inner diameter of said through bore whereby an abutment stop is formed limiting the spring initiated restoring movement of the firing pin, which first intermediate section has an outer diameter which is smaller than the inner diameter and an axial length corresponding to the axial length of said through bore, which second intermediate section has an outer diameter corresponding to the inner diameter of said through bore such to be receivable therein and has an axial length corresponding to the axial length of said through bore, which second collar has an outer diameter which is larger than the inner diameter of said through bore whereby a further abutment stop is formed limiting the hammer initiated firing movement of said firing pin.

* * * * *